US007195559B2

(12) United States Patent
Gilmore et al.

(10) Patent No.: US 7,195,559 B2
(45) Date of Patent: Mar. 27, 2007

(54) SLOT MACHINE WITH DYNAMIC WILD SYMBOL FEATURE

(75) Inventors: Jason C. Gilmore, Bartlett, IL (US); Wesley D. Stayte, Des Plaines, IL (US)

(73) Assignee: WMS Gaming Inc., Waukegan, IL (US)

( * ) Notice: Subject to any disclaimer, the term of this patent is extended or adjusted under 35 U.S.C. 154(b) by 49 days.

(21) Appl. No.: 10/223,504

(22) Filed: Aug. 19, 2002

(65) Prior Publication Data

US 2004/0033827 A1 Feb. 19, 2004

(51) Int. Cl.
*G07F 17/34* (2006.01)

(52) U.S. Cl. ..... 463/20; 273/143 R; 273/138.2

(58) Field of Classification Search ..... 273/143 R, 273/138.2, 138.1; 463/20, 12, 13
See application file for complete search history.

(56) References Cited

U.S. PATENT DOCUMENTS

| | | | | |
|---|---|---|---|---|
| 6,089,977 | A | 7/2000 | Bennett | 463/20 |
| 6,190,254 | B1 | 2/2001 | Bennett | 463/13 |
| 6,251,013 | B1 | 6/2001 | Bennett | 463/13 |
| 6,270,411 | B1 | 8/2001 | Gura et al. | 463/20 |
| 6,290,600 | B1 * | 9/2001 | Glasson | 463/20 |
| 6,311,976 | B1 * | 11/2001 | Yoseloff et al. | 273/138.2 |
| 2002/0025849 | A1 * | 2/2002 | Olive | 463/20 |
| 2002/0039918 | A1 * | 4/2002 | Anderson et al. | 463/16 |
| 2002/0047238 | A1 * | 4/2002 | Ainsworth et al. | 273/292 |
| 2003/0064779 | A1 * | 4/2003 | Suda | 463/20 |

FOREIGN PATENT DOCUMENTS

| | | | |
|---|---|---|---|
| EP | 1150261 | A2 | 10/2001 |
| GB | 2097160 | A | 10/1982 |

* cited by examiner

*Primary Examiner*—Benjamin Layno
(74) *Attorney, Agent, or Firm*—Jenkens & Gilchrist

(57) ABSTRACT

A slot machine conducts a wagering game in which a plurality of arrays of symbols are successively displayed. Each array may, for example, result from a free spin of a plurality of symbol-bearing reels. In each free spin, the reels are rotated and stopped to place the symbols on the reels in visual association with a display area. One or more of the symbols of each array are designated as wild. Payouts for the successive arrays are awarded according to a pay table. In one embodiment, the plurality of arrays are successively displayed during a bonus game triggered by a start-bonus outcome in a basic game.

22 Claims, 12 Drawing Sheets

SLOT MACHINE WITH DYNAMIC WILD SYMBOL FEATURE

FIELD OF THE INVENTION

The present invention relates generally to gaming machines and, more particularly, to a slot machine including a dynamic wild symbol feature.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome of the basic game. Because the bonus game concept offers tremendous advantages in player appeal and excitement relative to other known games, and because such games are attractive to both players and operators, there is a continuing need to develop new features and themes for bonus games to satisfy the demands of players and operators. Preferably, such new bonus game features and themes will maintain, or even further enhance, the level of player excitement offered by bonus games heretofore known in the art. The present invention is directed to satisfying these needs.

SUMMARY OF THE INVENTION

A slot machine conducts a wagering game in which a plurality of arrays of symbols are successively displayed. Each array may, for example, result from a free spin of a plurality of symbol-bearing reels. In each free spin, the reels are rotated and stopped to place the symbols on the reels in visual association with a display area. One or more of the symbols of each array are designated as wild. Payouts for the successive arrays are awarded according to a pay table. In one embodiment, the plurality of arrays are successively displayed during a bonus game triggered by a start-bonus outcome in a basic game.

BRIEF DESCRIPTION OF THE DRAWINGS

The foregoing and other advantages of the invention will become apparent upon reading the following detailed description and upon reference to the drawings in which.

Figure 1:
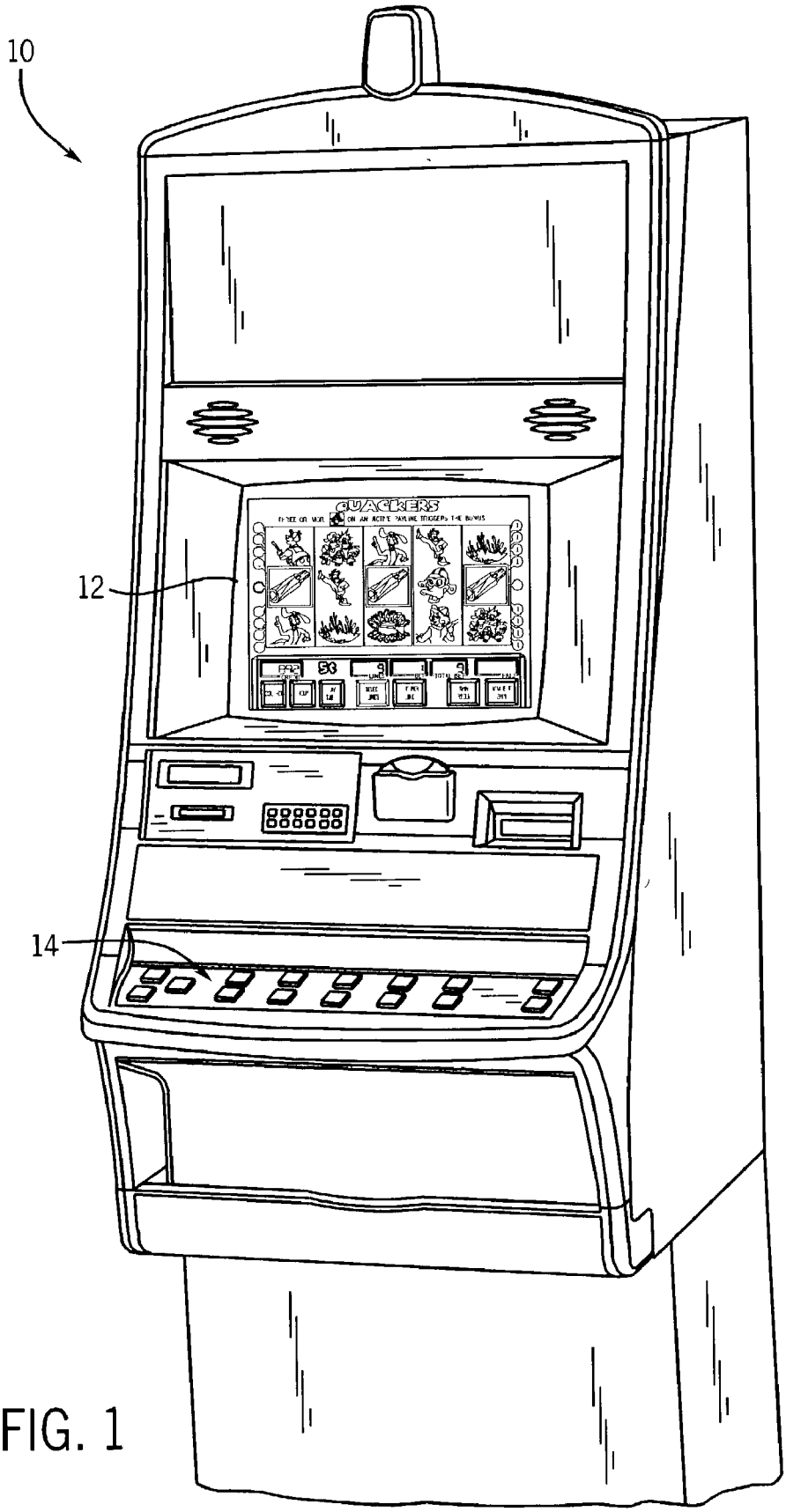
FIG. 1 is a perspective view of a gaming machine embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, a gaming machine 10 is operable to play a wagering game having a humorous duck hunting theme. The wagering game includes a basic slot game with five simulated spinning reels and a dynamic wild symbol feature triggered by a start-feature outcome in the basic slot game. In addition to the wild symbol feature, the basic slot game may produce certain outcomes for triggering other special features and bonus games.

The gaming machine 10 includes a visual display 12 preferably in the form of a dot matrix, CRT, LED, LCD, electro-luminescent, or other type of video display known in the art. The display 12 preferably includes a touch screen overlaying the monitor. In the illustrated embodiment, the gaming machine 10 is an "upright" version in which the display 12 is oriented vertically relative to the player. Alternatively, the gaming machine may be a "slant-top" version in which the display 12 is slanted at about a thirty-degree angle toward the player of the gaming machine 10.

Figure 2:
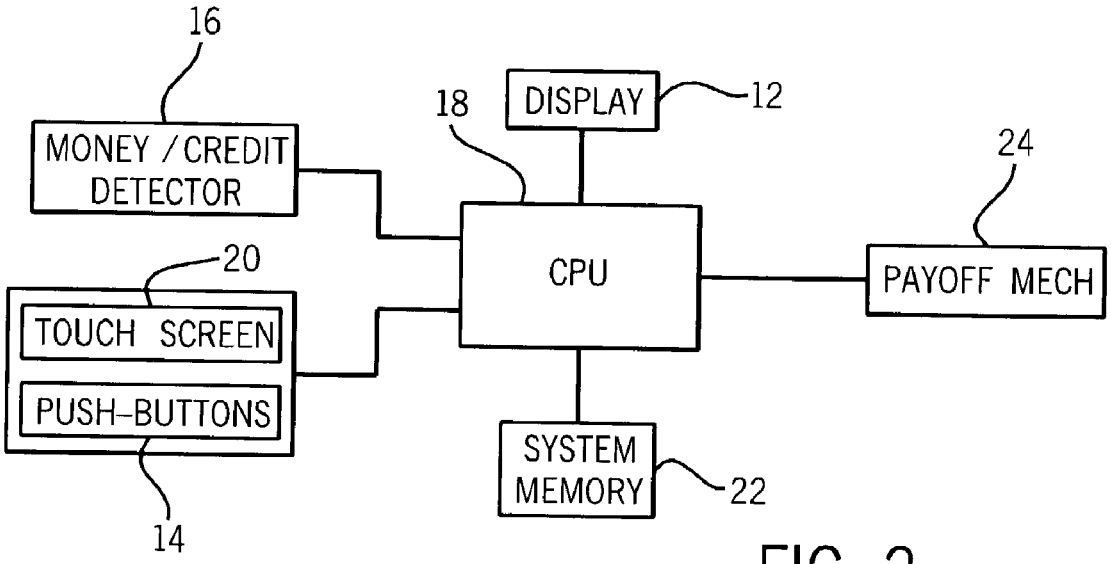
FIG. 2 is a block diagram of a control system suitable for operating the gaming machine.

FIG. 2 is a block diagram of a control system suitable for operating the gaming machine 10. Money/credit detector 16 signals a central processing unit ("CPU") 18 when a player has inserted money or played a number of credits. The money may be provided by coins, bills, tickets, coupons, cards, etc. Then, the CPU 18 operates to execute a game program that causes the display 12 to display five simulated symbol-bearing reels. The player may select a number of pay lines to play, an amount to wager, and start game play via the touch screen 20 or the push-buttons 14, causing the CPU 18 to set the reels in motion, randomly select a game outcome, and then stop the reels to display symbols corresponding to the pre-selected game outcome. In one embodiment, one of the basic game outcomes triggers a dynamic wild symbol feature.

A system memory 22 stores control software, operational instructions and data associated with the gaming machine 10. In one embodiment, the system memory 22 comprises a separate read-only memory (ROM) and battery-backed random-access memory (RAM). However, it will be appreciated that the system memory 22 may be implemented on any of several alternative types of memory structures or may be implemented on a single memory structure. A payoff mechanism 24 is operable in response to instructions from the CPU 18 to award a payoff to the player in response to certain winning outcomes that might occur in the basic game or the dynamic wild symbol feature. The payoff may be provided in the form of coins, bills, tickets, coupons, cards, etc. The payoff amounts are determined by one or more pay tables stored in the system memory 22.

Figure 3:
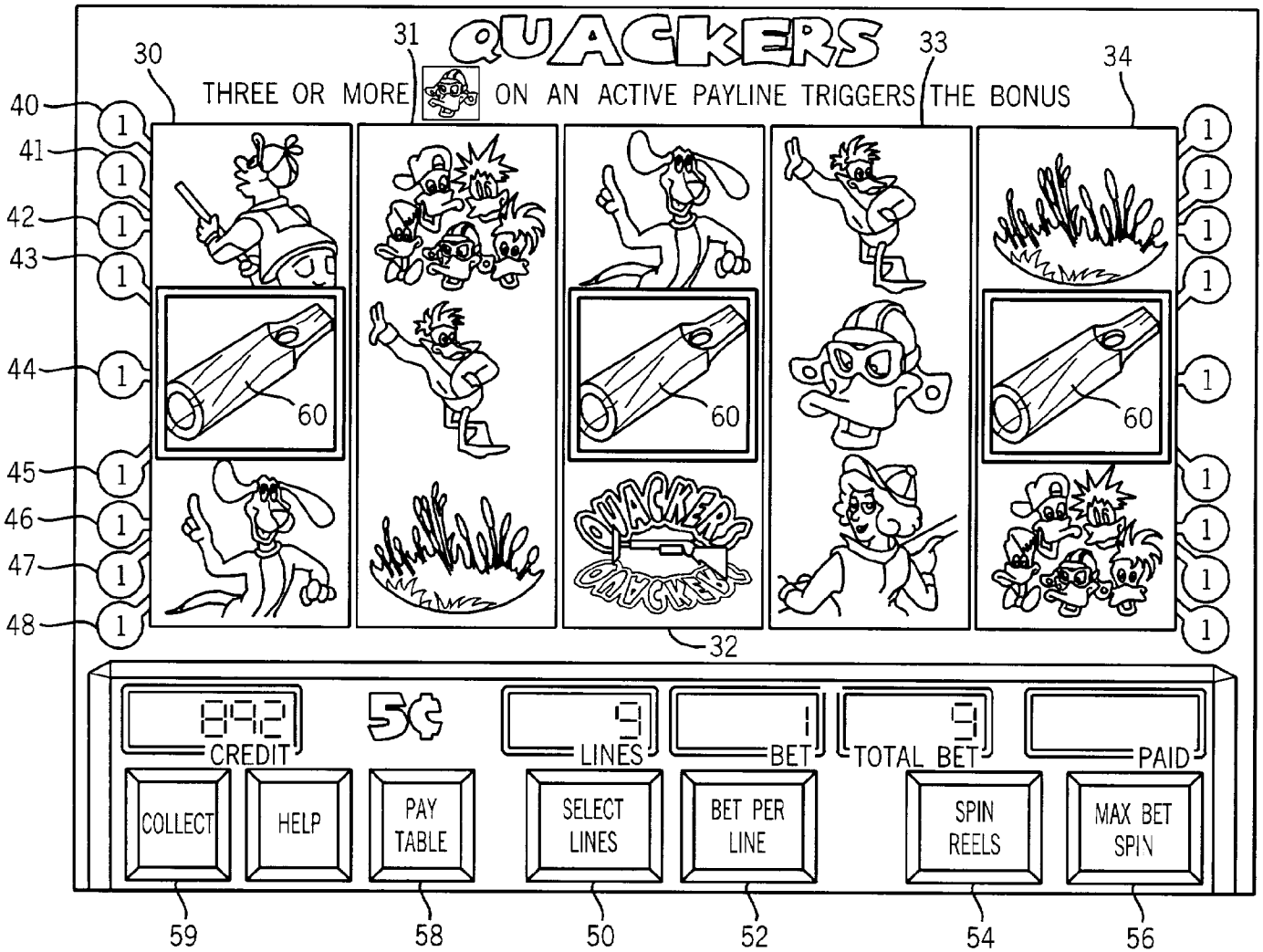
FIG. 3 is a display image associated with a basic slot game and showing a symbol combination for triggering a dynamic wild symbol feature.

Referring to FIG. 3, the basic game is implemented on the display 12 on five video simulated spinning reels 30–34 with nine pay lines 40–48. Each of the pay lines 40–48 extends through one symbol on each of the five reels 30–34. Generally, game play is initiated by inserting money or playing a number of credits, causing the CPU to activate a number of pay lines corresponding to the amount of money or number of credits played. In one embodiment, the player selects the number of pay lines (between one and nine) to play by pressing a "Select Lines" key 50 on the video display 12. The player then chooses the number of coins or credits to bet on the selected pay lines by pressing the "Bet Per Line" key 52.

After activation of the pay lines, the reels 30–34 may be set in motion by touching the "Spin Reels" key 54 or, if the player wishes to bet the maximum amount per line, by using the "Max Bet Spin" key 56 on the video display 12. Alternatively, other mechanisms such as, for example, a lever or push button may be used to set the reels in motion. The CPU uses a random number generator to select a game outcome (e.g., "basic" game outcome) corresponding to a particular set of reel "stop positions." The CPU then causes each of the video reels 30–34 to stop at the appropriate stop position. Video symbols are displayed on the reels 30–34 to graphically illustrate the reel stop positions and indicate whether the stop positions of the reels represent a winning game outcome.

Winning basic game outcomes (e.g., symbol combinations resulting in payment of coins or credits) are identifiable to the player by a pay table. In one embodiment, the pay table is affixed to the machine 10 and/or displayed by the video display 12 in response to a command by the player (e.g., by pressing the "Pay Table" button 58). A winning basic game outcome occurs when the symbols appearing on the reels 30–34 along an active pay line correspond to one of the winning combinations on the pay table. A winning combination, for example, could be three or more matching symbols along an active pay line, where the award is greater as the number of matching symbols along the active pay line increases. If the displayed symbols stop in a winning combination, the game credits the player an amount corresponding to the award in the pay table for that combination multiplied by the amount of credits bet on the winning pay line. The player may collect the amount of accumulated credits by pressing the "Collect" button 59. In one implementation, the winning combinations start from the first reel 30 (left to right) and span adjacent reels. In an alternative implementation, the winning combinations start from either the first reel 30 (left to right) or the fifth reel 34 (right to left) and span adjacent reels.

Included among the plurality of basic game outcomes is a start-feature outcome for triggering play of a dynamic wild symbol feature. A start-feature outcome may be defined in any number of ways. For example, a start-feature outcome occurs when a special start-feature symbol or a special combination of symbols appears on one or more of the reels 30–34. The start-feature outcome may require the combination of symbols to appear along an active pay line, or may alternatively require that the combination of symbols appear anywhere on the display regardless of whether the symbols are along an active pay line. The appearance of the appropriate start-feature outcome causes the CPU to shift operation from the basic game to the dynamic wild symbol feature of the present invention.

In the embodiment illustrated in FIG. 3, the appearance of three scattered DUCK CALLER symbols 60 anywhere on the display triggers a dynamic wild symbol feature called a Wild Duck Bonus. The DUCK CALLER symbols 60 are highlighted using, for example, a flashing border.

Figure 4:
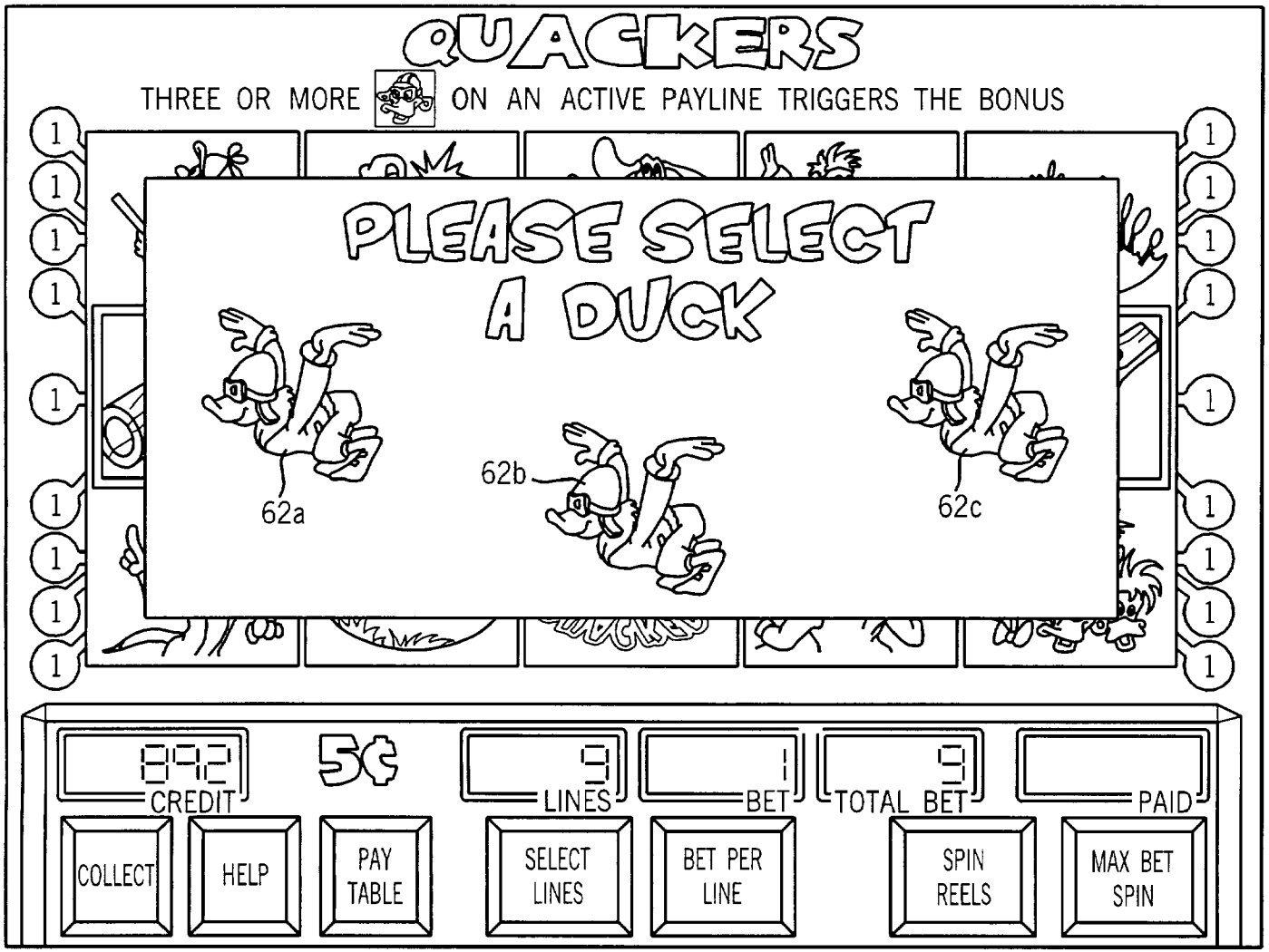
FIGS. 4 through 12 are display images associated with the dynamic wild symbol feature.
Figure 5:
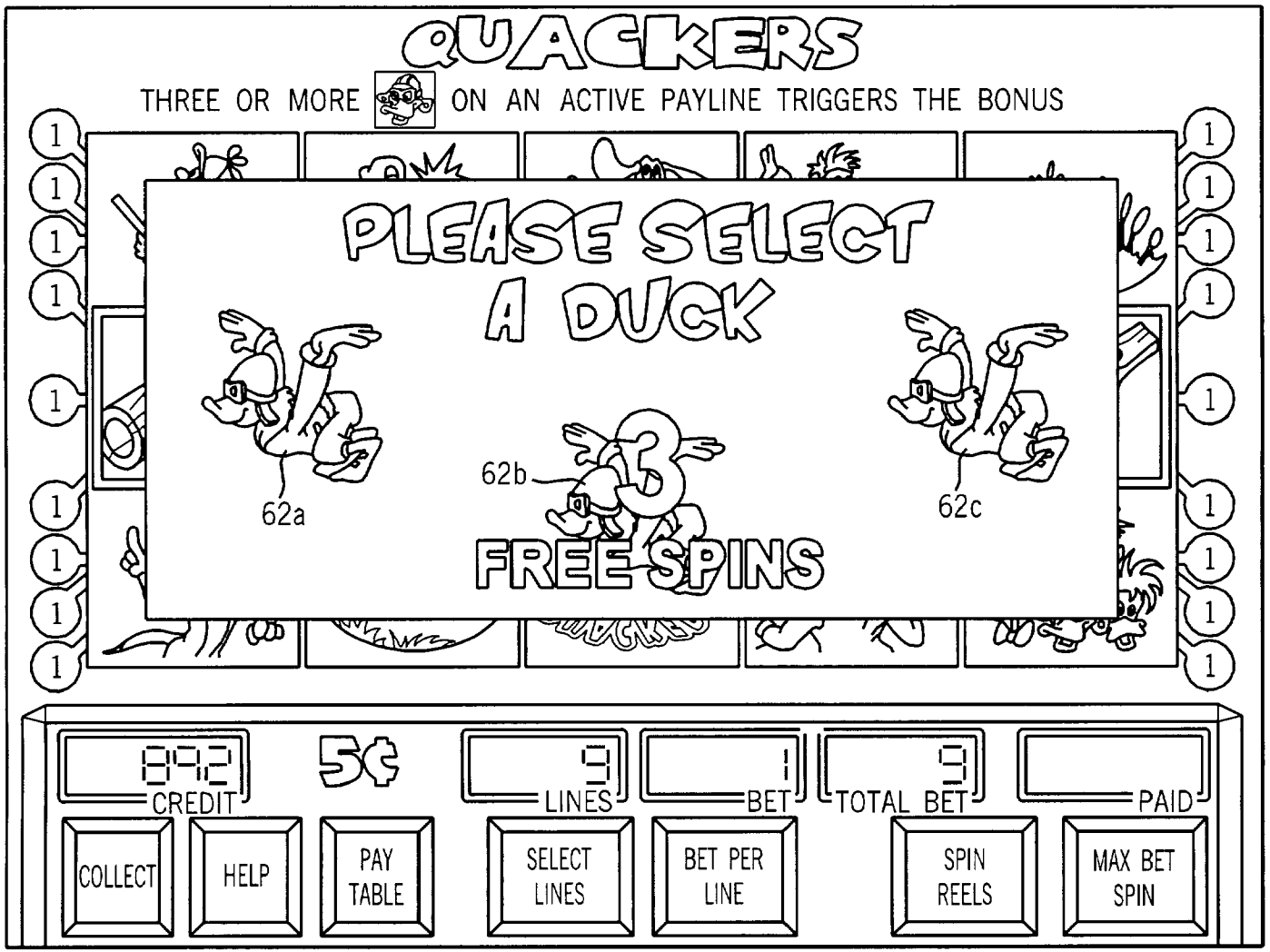
Figure 6:
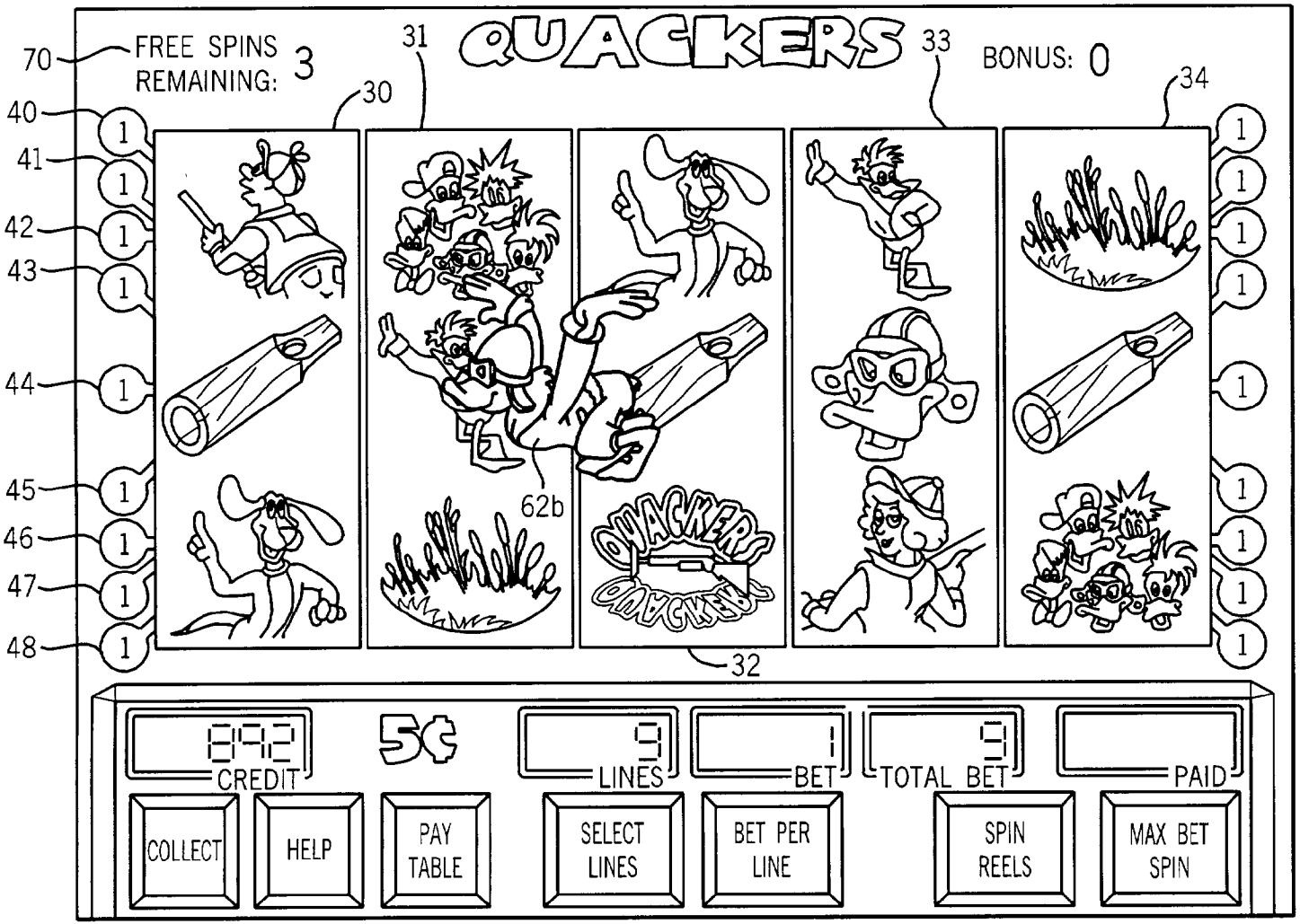
Figure 7:
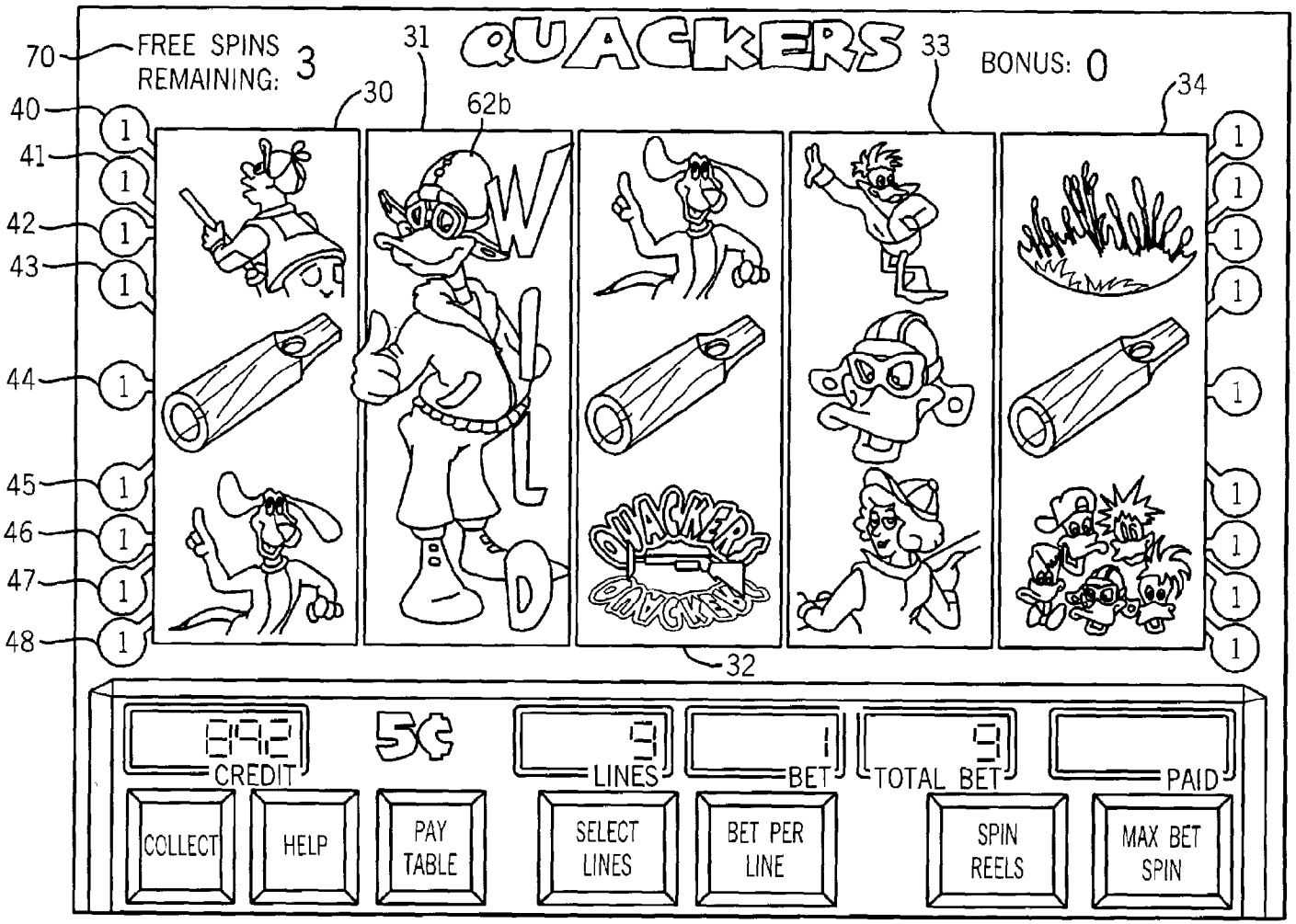

Referring to FIG. 4, a popup window appears over the reels. The player is prompted to select one of three comical "flyer" ducks 62*a*, 62*b*, and 62*c* appearing in the popup window. Referring to FIG. 5, selecting one of the ducks 62*a*–*c* reveals a credit amount or a number of free spins of the reels (e.g., 3, 5, or 7 free spins). In the illustrated example, the selected duck 62*b* reveals three free spins of the reels. Referring to FIG. 6, after the popup window and the unselected ducks disappear, the selected duck 62*b* randomly flies to one of the reels on the display. In the illustrated example, the duck 62*b* lands on reel 31. Referring to FIG. 7, the reel symbols of the landing reel (e.g., reel 31) on which the duck 62*b* lands disappear. The duck 62*b* stretches vertically to fill the entire height of the landing reel (e.g., reel 31), locks the landing reel, and makes the landing reel wild as denoted by the text "wild" appearing thereon. As noted above, selecting the duck 62*b* in FIG. 5 revealed three free spins. A free spin counter 70 shows a number of free spins remaining in the Wild Duck Bonus.

Figure 8:
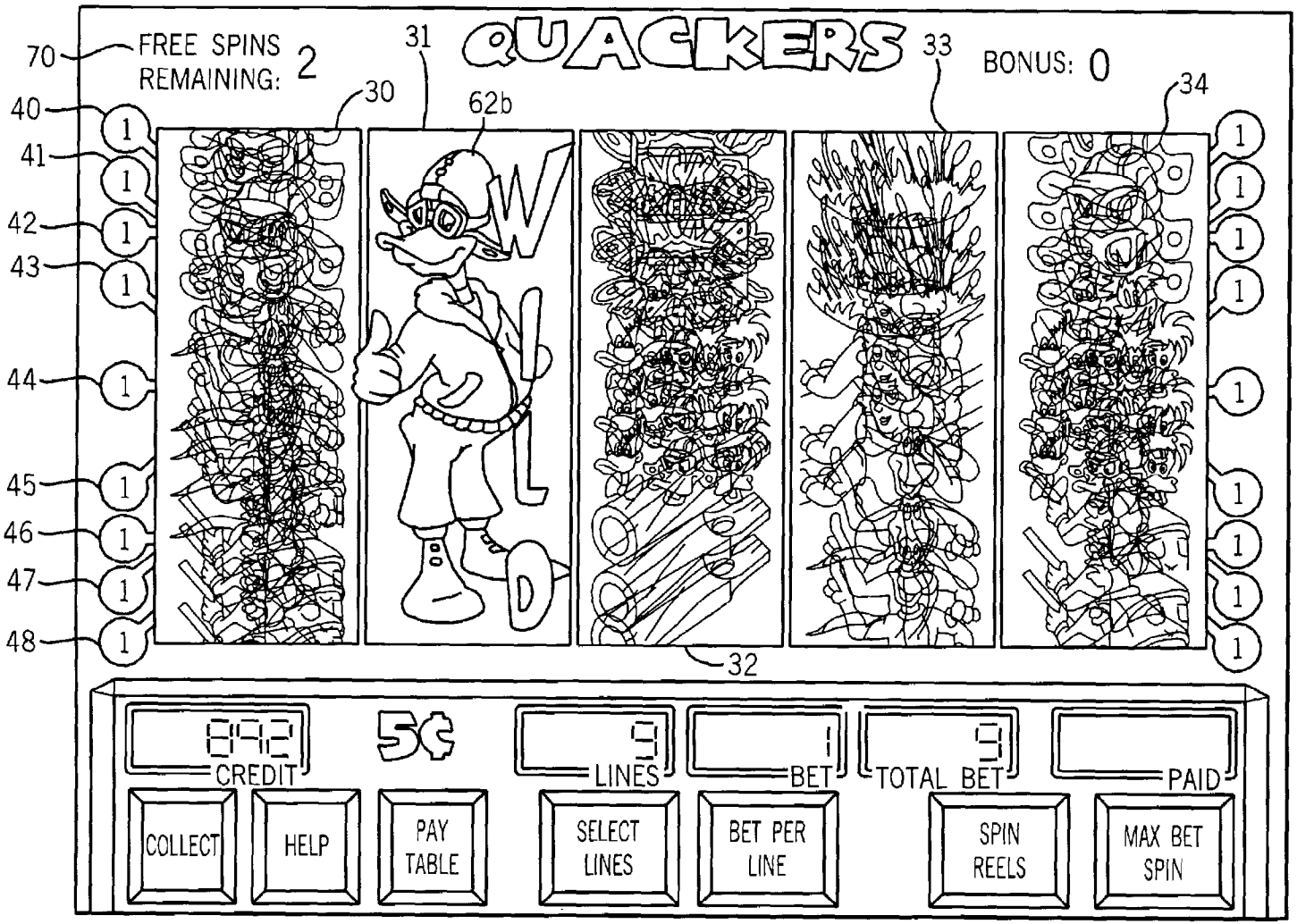
Figure 9:
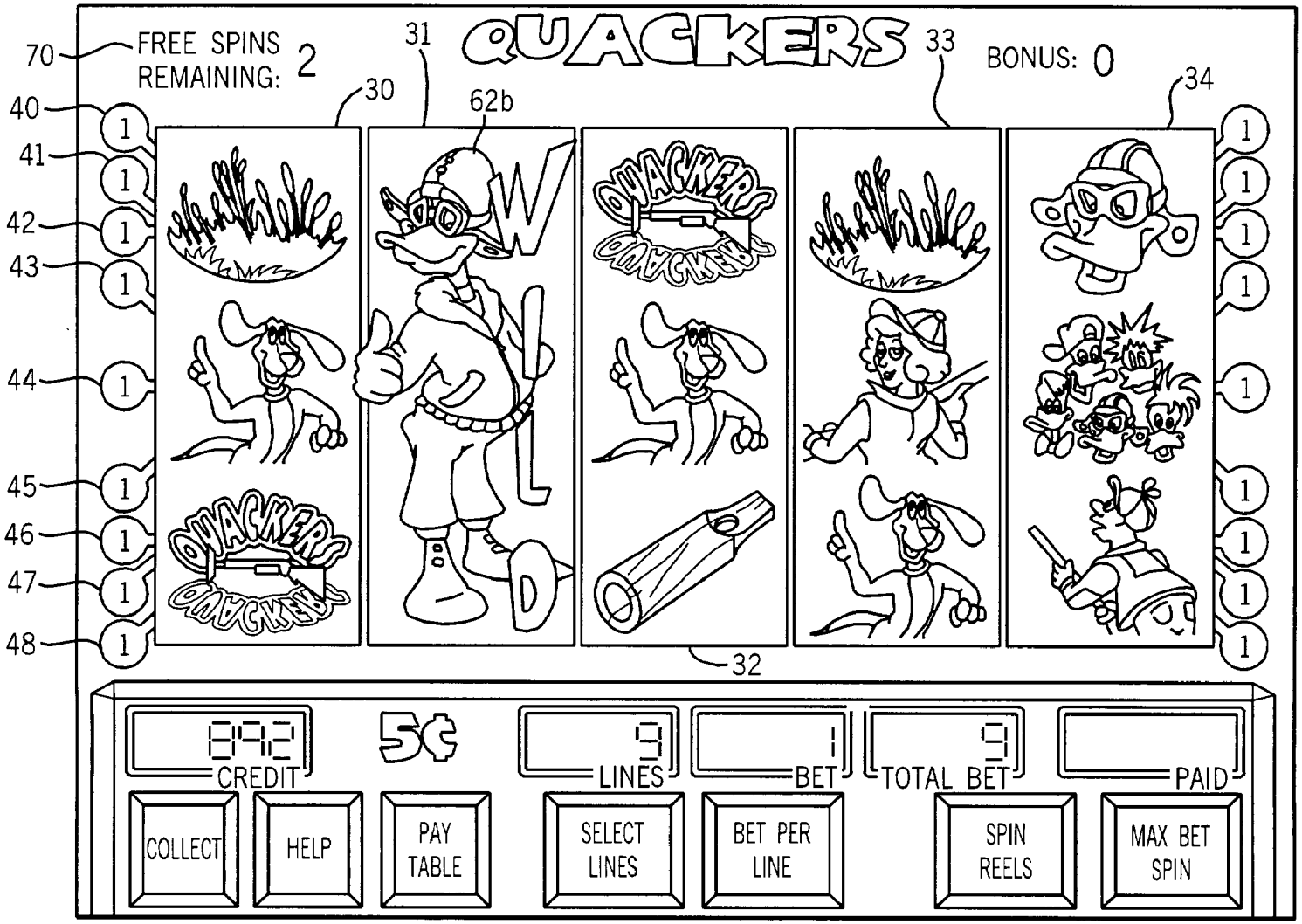
Figure 10:
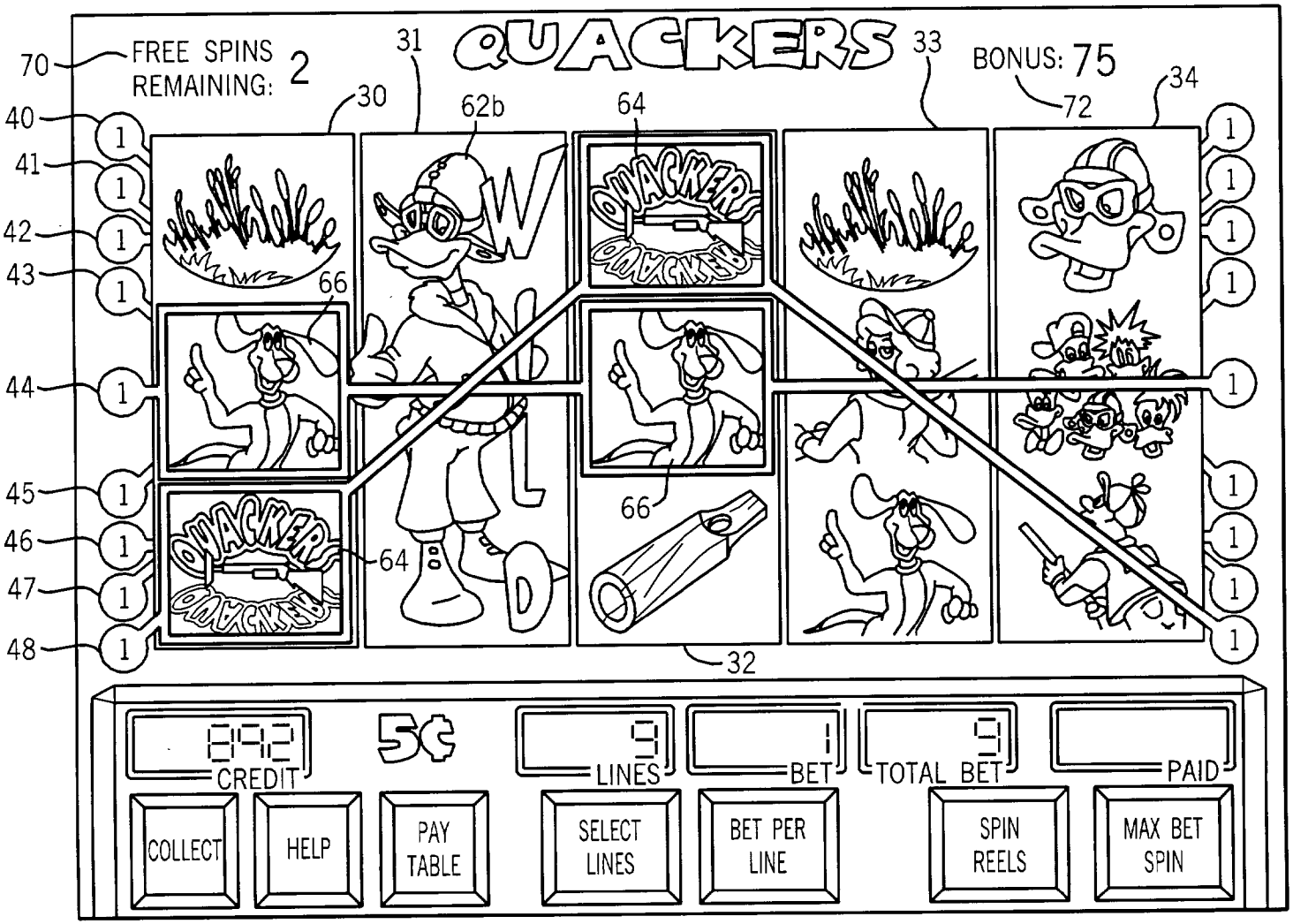

Referring to FIGS. 8 and 9, the Wild Duck Bonus proceeds with the first free spin in which the remaining reels (e.g., reels 30, 32, 33, and 34) are spun (see FIG. 8) and stopped (see FIG. 9) according to a game outcome randomly selected by the CPU. The CPU uses a random number generator to select the game outcome. Referring to FIG. 10, after the reels are stopped, the player is provided an award for each winning combination appearing on the reels. As noted above, the pay table identifies the possible winning combinations and their respective awards. In the illustrated example, the reel 31 is wild when evaluating the symbol array for any winning combinations. The first free spin yielded (1) a first winning combination of three QUACKERS symbols formed by a QUACKERS symbol 64 on reel 30, wild reel 31, and a QUACKERS symbol 64 on reel 32, and (2) a second winning combination of three HOUND symbols formed by a HOUND symbol 66 on reel 30, wild reel 31, and a HOUND symbol 66 on reel 32. These winning combinations yield a bonus of 75 credits shown on a bonus meter 72.

Figure 11:
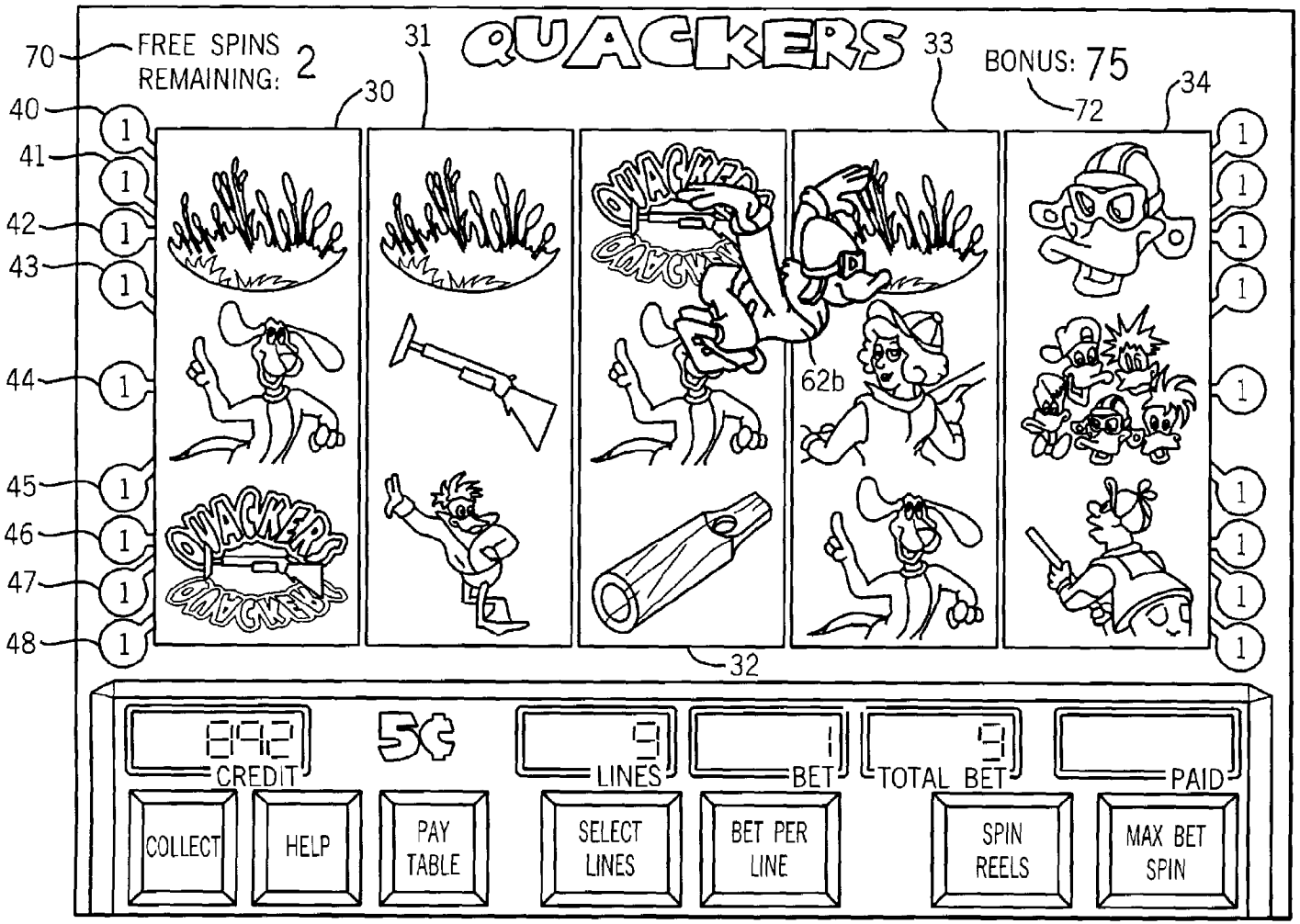
Figure 12:
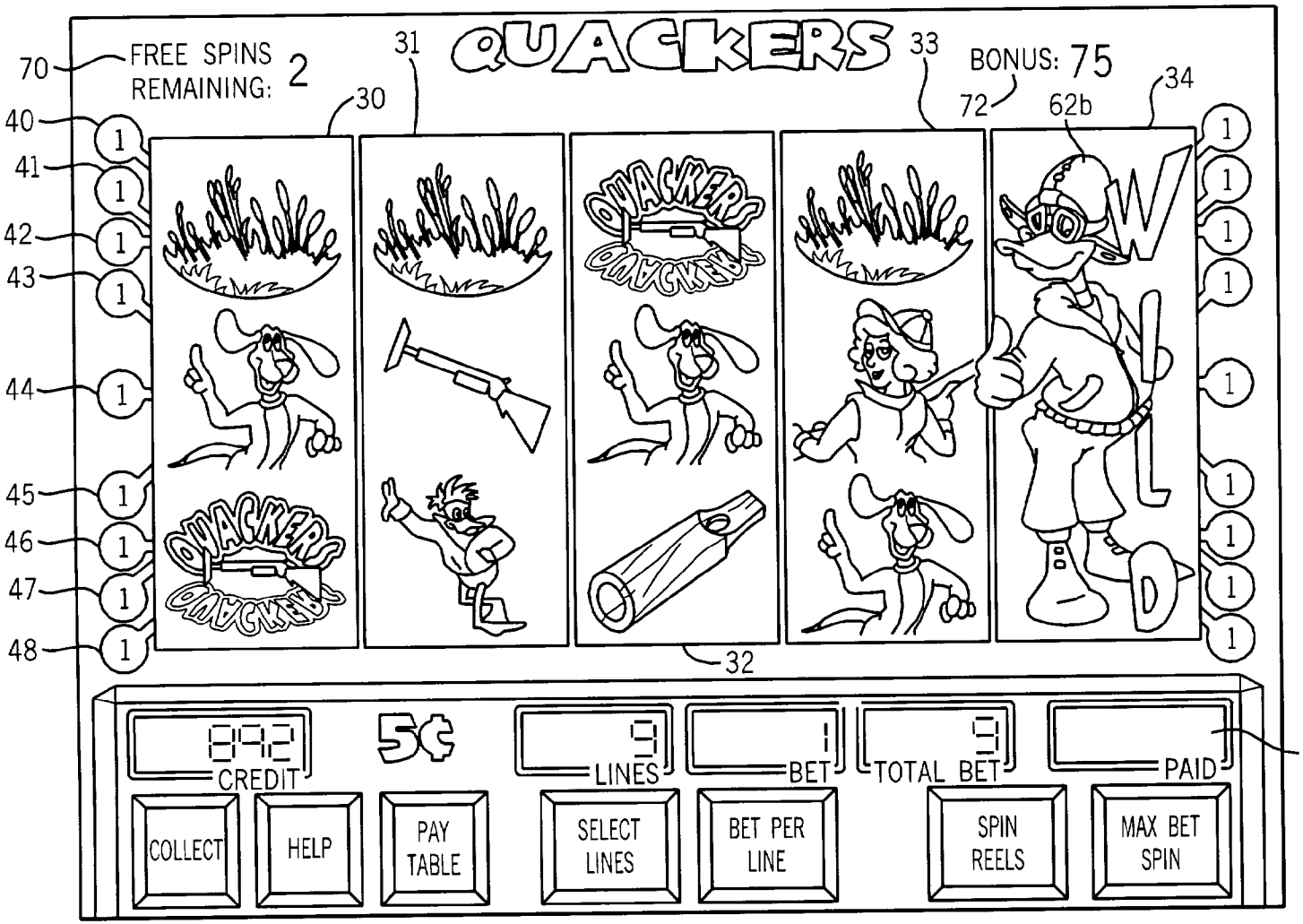

The Wild Duck Bonus then prepares for and executes each subsequent free spin in the same manner as described above for the first free spin. For example, referring to FIG. 11, to prepare for the second free spin, the stretched duck 62*b* on reel 31 shrinks back to its original size and randomly flies to another reel on the display. In the illustrated example, the duck 62*b* lands on reel 34. Referring to FIG. 12, the reel symbols of the landing reel (e.g., reel 34) on which the duck 62*b* lands disappear. The duck 62*b* stretches out to the entire height of the landing reel (e.g., reel 34), locks the landing reel, and makes the landing reel wild for the second free spin. The Wild Duck Bonus then proceeds with the second free spin of the reels and evaluates the resulting symbol array for any winning combinations.

After the last free spin (e.g., after the third free spin in the illustrated example), the Wild Duck Bonus concludes with the wild duck 62*b* flying off the display and all credits accumulated in the bonus meter 72 being added to a paid meter 74 (see FIG. 12). The CPU then shifts operation back to the basic slot game.

In a preferred embodiment, the pay table, the reel symbols, and the number and arrangement of the reel symbols on each reel are the same in both the basic slot game and the Wild Duck Bonus, except that the wild duck randomly selects one of the reels to be wild prior to each free spin. Alternatively, the Wild Duck Bonus may utilize a different pay table and different reel symbols.

While the present invention has been described with reference to one or more particular embodiments, those skilled in the art will recognize that many changes may be made thereto without departing from the spirit and scope of the present invention. For example, the dynamic wild symbol feature may be played on a symbol array in which each symbol is generated independently of the other symbols. Also, instead of randomly designating an entire reel as wild for the next free spin, the wild duck may randomly designate a particular reel symbol, symbol position, group of reel symbols, or group of symbol positions as wild for the next free reel spin. Furthermore, instead of designating a reel symbol(s) as wild, the duck may designate a reel symbol(s) to have some other special function for the next reel spin. The special function may, for example, be a scatter function such that a winning combination formed with the designated symbol need not appear along a pay line, but rather may appear anywhere on the display. Each of these embodiments and obvious variations thereof is contemplated as falling within the spirit and scope of the claimed invention, which is set forth in the following claims.

What is claimed is:

1. A method of conducting a wagering game on a gaming machine, comprising:

receiving a wager from a player to initiate a play of the wagering game, said play being associated with the wager;

successively displaying a plurality of different arrays of symbols on a display area during said play of the wagering game, wherein each array is comprised of a plurality of rows and columns;

randomly designating one or more of the symbols of each array as wild; and awarding payouts for the successive arrays according to a pay table.

2. The method of claim 1, wherein each array is generated by a plurality of symbol-bearing reels that are rotated and stopped to place the symbols on the reels in visual association with the display area.

3. A method conducting a wagering game on a gaming machine, comprising:

receiving a wager from a player to initiate a play of the wagering game, said play being associated with the wager;

successively displaying a plurality of different arrays of symbols on a display area during said play of the wagering game, wherein each array is comprised of a plurality of rows and columns;

randomly designating one or more of the symbols of each array as wild; and awarding payouts for the successive arrays according to a pay table, wherein each array is generated by a plurality of symbol-bearing reels that are rotated and stopped to place the symbols on the reels in visual association with the display area, and wherein the step of randomly designating one or more of the symbols of each array as wild includes randomly designating only one of the reels as wild.

4. The method of claim 3, wherein the step of designating one of the reels as wild includes moving a wild symbol to the designated reel and expanding the wild symbol to substantially fill a visible portion of the reel.

5. The method of claim 3, wherein the step of designating one of the reels as wild includes randomly designating said one of the reels as wild.

6. The method of claim 1, wherein the step of designating one or more of the symbols of each array as wild includes randomly designating the one or more of the symbols of each array as wild.

7. The method of claim 1, wherein the step of designating one or more of the symbols of each array as wild includes moving a wild symbol to the designated one or more of the symbols.

8. The method of claim 1, further including conducting a basic game in response to the wager and conducting a bonus game in response to a start-bonus outcome in the basic game, the bonus game including the successively displaying step, the designating step, and the awarding step.

9. The method of claim 1, wherein the step of successively displaying a plurality of arrays of symbols is triggered by a special outcome in a basic game.

10. A method of conducting a wagering game on a gaming machine, comprising:

receiving a wager from a player to initiate a play of the wagering game;

successively displaying a plurality of different array of symbols on a plurality of symbol-bearing reels during the play of the wagering game, wherein in each spin the plurality of reels are rotated and stopped to place symbols on the reels in visual association with a display area;

randomly designating one of the reels as wild for each spin; and awarding payouts for each of the spins according to a pay table.

11. The method of claim 10, wherein the step of successively displaying free spins is triggered by a special outcome in a basic game.

12. The method of claim 10, wherein the step of designating one of the reels as wild for each free spin occurs prior to the free spin.

13. The method of claim 10, wherein the step of designating one of the reels as wild for each free spin includes moving a wild symbol to the designated reel and expanding the wild symbol to substantially fill a visible portion of the reel.

14. A gaming machine comprising:

a wagering apparatus for receiving a wager from a player to initiate a play of a wagering game, said play being associated with the wager;

a display for successively displaying a plurality of different arrays of symbols on a display area during said play of the wagering game, wherein each array is comprised of a plurality of rows and columns;

means for designating one or more of the symbols of each array as wild; and an award apparatus for awarding payouts for the successive arrays according to a pay table, wherein the symbols of each array are randomly selected.

15. The machine of claim 14, wherein each array is generated by a plurality of symbol-bearing reels that are rotated and stopped to place the symbols on the reels in visual association with the display area.

16. The machine of claim 14, wherein the means for designating one or more of the symbols of each array as wild includes means for randomly designating the one or more of the symbols of each array as wild.

17. The machine of claim 14, wherein the means for designating one or more of the symbols of each array as wild includes means for moving a wild symbol to the designated one or more of the symbols.

18. The machine of claim 14, wherein the means for successively displaying a plurality of arrays of symbols is responsive to a special outcome in a basic game.

19. A gaming machine, comprising:

a wagering apparatus for receiving a wager from a player to initiate a play of a wagering game, said play being associated with the wager;

a display for successively displaying a plurality of different arrays of symbols on a display area during said play of the wagering game, wherein each array is comprised of a plurality of rows and columns;

means for designating one or more of the symbols of each array as wild; and an award apparatus for awarding payouts for the successive arrays according to a pay table, wherein each array is generated by a plurality of symbol-bearing reels that are rotated and stopped to place the symbols on the reels in visual association with the display area, and wherein the means for designating one or more of the symbols of each array as wild includes means for designating one of the reels as wild.

20. The machine of claim 19, wherein the means for designating one of the reels as wild includes means for moving a wild symbol to the designated reel and expanding the wild symbol to substantially fill a visible portion of the reel.

21. The machine of claim 19, wherein the means for designating one of the reels as wild includes means for randomly designating one of the reels as wild.

22. A method of conducting a wagering game on a gaming machine, comprising:

receiving a wager from a player to initiate a play of the wagering game, said play being associated with the wager;

successively displaying a plurality of different arrays of symbols on a display area during said play of the wagering game, wherein each array is comprised of a plurality of rows and columns;

randomly designating one or more of the symbols of each array as having a special function; and awarding payouts for the successive arrays according to a pay table.

* * * * *